US011761456B2

(12) United States Patent
Imahigashi et al.

(10) Patent No.: US 11,761,456 B2
(45) Date of Patent: Sep. 19, 2023

(54) CENTRIFUGAL FAN AND BLOWER EQUIPPED WITH THE CENTRIFUGAL FAN

(71) Applicant: DENSO CORPORATION, Kariya (JP)

(72) Inventors: Shoichi Imahigashi, Kariya (JP); Syuzou Oda, Kariya (JP)

(73) Assignee: DENSO CORPORATION, Kariya (JP)

( * ) Notice: Subject to any disclaimer, the term of this patent is extended or adjusted under 35 U.S.C. 154(b) by 192 days.

(21) Appl. No.: 17/479,805

(22) Filed: Sep. 20, 2021

(65) Prior Publication Data

US 2022/0003243 A1 Jan. 6, 2022

Related U.S. Application Data

(63) Continuation of application No. PCT/JP2020/016203, filed on Apr. 10, 2020.

(30) Foreign Application Priority Data

Apr. 25, 2019 (JP) ..... 2019-084667

(51) Int. Cl.

| | |
|---|---|
| ***F03B 1/04*** | (2006.01) |
| ***F04D 29/42*** | (2006.01) |
| ***F04D 17/16*** | (2006.01) |
| ***F04D 29/28*** | (2006.01) |

(52) U.S. Cl.

CPC ..... *F04D 29/4226* (2013.01); *F04D 17/16* (2013.01); *F04D 29/281* (2013.01)

(58) Field of Classification Search

CPC .. F04D 29/30; F04D 29/281; F05D 2240/303; F24F 1/0022

USPC ..... 415/203

See application file for complete search history.

(56) References Cited

U.S. PATENT DOCUMENTS

| | | | | |
|---|---|---|---|---|
| 4,647,271 | A | 3/1987 | Nagai et al. | |
| 7,780,405 | B2 * | 8/2010 | Araki | F04D 29/5806 415/206 |
| 2005/0163614 | A1 | 7/2005 | Chapman | |
| 2006/0140758 | A1 | 6/2006 | Ochiai et al. | |

(Continued)

FOREIGN PATENT DOCUMENTS

| | | | |
|---|---|---|---|
| JP | H0574719 | B2 | 10/1993 |
| JP | H06330894 | A | 11/1994 |

(Continued)

*Primary Examiner* — Long T Tran
*Assistant Examiner* — James J Kim
(74) *Attorney, Agent, or Firm* — Harness, Dickey & Pierce, P.L.C.

(57) ABSTRACT

A centrifugal fan sucks in air from one side in an axial direction and blows out air outward in a radial direction. A blade leading edge is connected to a cylinder inner surface of a side plate. The blade leading edge has: a tip end extended linearly by an apex of a convex surface and connected to the cylinder inner surface; and a convex surface end indicating a boundary between the convex surface and a side surface of the blade. When the cylinder inner surface has: a diameter Φa at a first position, which is an end position of the upstream tubular portion of the side plate on one side in the axial direction, a diameter Φb at a second position where the blade leading edge is connected; and a diameter Φc at a third position where the convex surface end is connected, a relationship of Φa≥Φb≥Φc is satisfied.

6 Claims, 4 Drawing Sheets

(56) References Cited

U.S. PATENT DOCUMENTS

| | | | | |
|---|---|---|---|---|
| 2011/0023526 | A1* | 2/2011 | Ohyama | F04D 29/30 416/223 R |
| 2016/0290353 | A1* | 10/2016 | Kasahara | F04D 29/30 |
| 2019/0293083 | A1 | 9/2019 | Ishii et al. | |
| 2022/0205650 | A1* | 6/2022 | Sato | F24F 1/0022 |

FOREIGN PATENT DOCUMENTS

| | | | |
|---|---|---|---|
| JP | H07293494 | A | 11/1995 |
| JP | H102299 | A | 1/1998 |
| JP | H11082382 | A | 3/1999 |
| JP | 2006200525 | A | 8/2006 |
| JP | 2007518933 | A | 7/2007 |
| JP | 2018119420 | A | 8/2018 |

* cited by examiner

CENTRIFUGAL FAN AND BLOWER EQUIPPED WITH THE CENTRIFUGAL FAN

CROSS REFERENCE TO RELATED APPLICATION

The present application is a continuation application of International Patent Application No. PCT/JP2020/016203 filed on Apr. 10, 2020, which designated the U.S. and claims the benefit of priority from Japanese Patent Application No. 2019-084667 filed on Apr. 25, 2019. The entire disclosures of all of the above applications are incorporated herein by reference.

TECHNICAL FIELD

The present disclosure relates to a centrifugal fan and a blower equipped with the centrifugal fan.

BACKGROUND

A centrifugal blower includes an impeller. The impeller includes a main plate, blade plates, and a side plate. The blade plate has one end on one side in the axial direction of the centrifugal fan and the other end on the other side in the axial direction. The one end of the blade plate is connected to the side plate, and the other end of the blade plate is connected to the main plate.

SUMMARY

According to one aspect of the present disclosure, a centrifugal fan configured to rotate around a fan axis so as to suck air from one side in an axial direction and blow out air outward in a radial direction for a blower, includes: a plurality of blades arranged around the fan axis and having a blade leading edge; a side plate connected to each of the plurality of blades on the one side in the axial direction, the side plate having an intake hole to suck air; and a main plate connected to each of the plurality of blades on a side opposite to the side plate. The side plate has: an upstream tubular portion that surrounds the intake hole and has a tubular shape with the fan axis; and a downstream diameter-expanded portion formed so as to extend outward in the radial direction from an end portion of the upstream tubular portion on the other side opposite to the one side in the axial direction. The upstream tubular portion has a cylinder inner surface facing the intake hole inward in the radial direction, and the blade leading edge has a convex surface protruding toward an upstream side in an air flow direction between the blades. The convex surface has an apex and a convex surface end indicating a boundary position between the convex surface and a side surface of the blade in a cross section representing a thickness of the blade, the apex continuing along the blade leading edge and connected to the cylinder inner surface such that the blade leading edge has a tip end extended linearly, the convex surface end being extended linearly along the blade leading edge. A relationship of $\Phi a \geq \Phi b \geq \Phi c$ is satisfied, in which the cylinder inner surface has a diameter $\Phi a$ about the fan axis at a first position corresponding to an end position of the upstream tubular portion on the one side in the axial direction, a diameter $\Phi b$ about the fan axis at a second position where the blade leading edge is connected to the cylinder inner surface, and a diameter $\Phi c$ about the fan axis at a third position where the convex surface end is connected to the cylinder inner surface.

DESCRIPTION OF EMBODIMENTS

Figure 1:
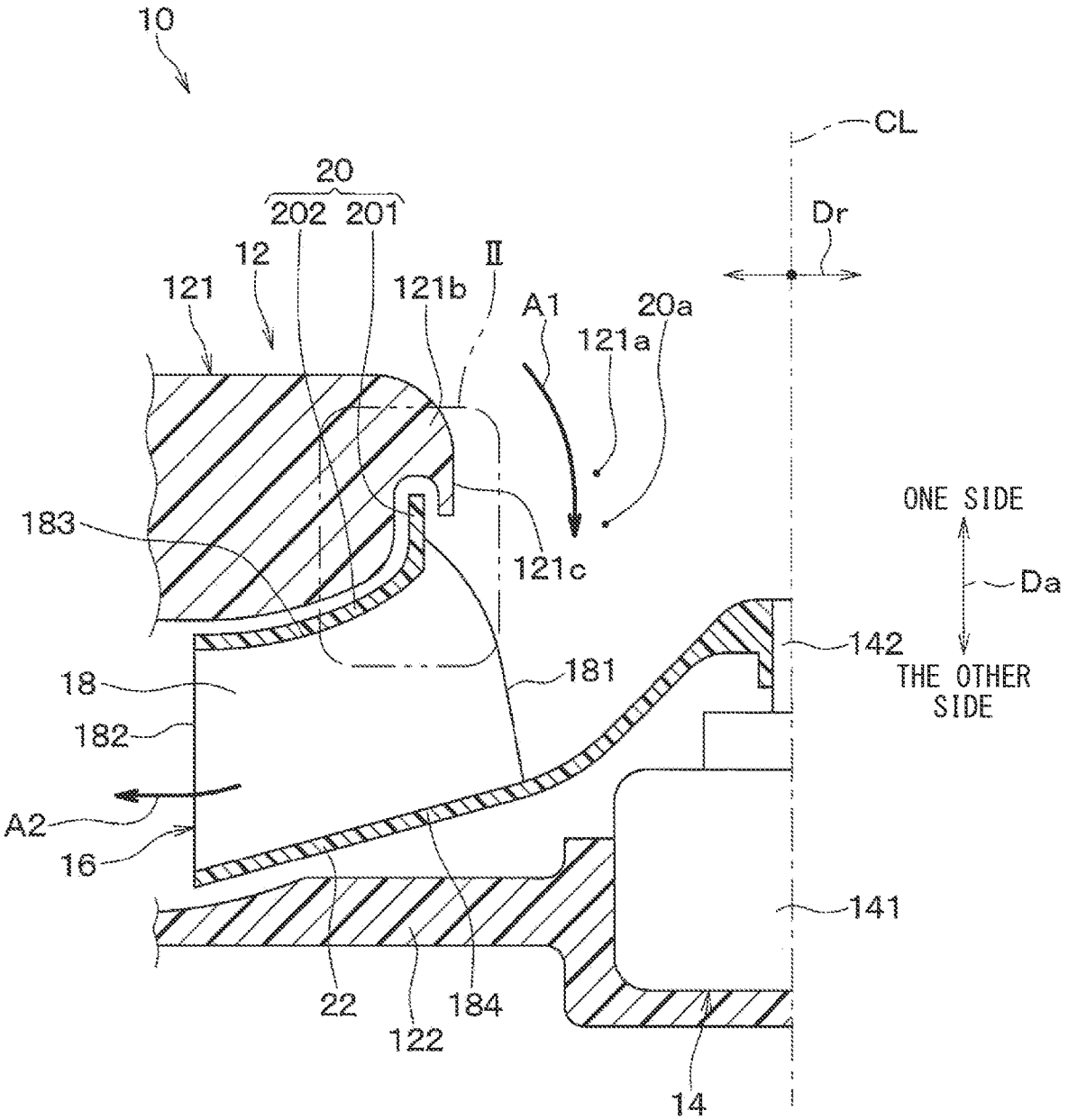
FIG. 1 is a schematic vertical cross-sectional view illustrating a centrifugal blower according to a first embodiment, taken along a plane including a fan axis of the centrifugal blower.

To begin with, examples of relevant techniques will be described.

As a blower provided with a centrifugal fan, a centrifugal blower includes a centrifugal fan which is an impeller. The impeller includes a main plate, blade plates, and a side plate. The blade plate has one end on one side in the axial direction of the centrifugal fan and the other end on the other side in the axial direction. The one end of the blade plate is connected to the side plate, and the other end of the blade plate is connected to the main plate.

Further, an intake hole for sucking air is formed in the center of the side plate of the centrifugal fan.

In the centrifugal fan of the centrifugal blower, the inner diameter of the intake hole of the side plate is smaller than the inner diameter of a portion of the blade leading edge in contact with the side plate. Therefore, when the centrifugal fan is molded by using a die, the die forming the blade leading edge cannot be moved to the one side (in other words, toward the intake hole) in the axial direction of the centrifugal fan. In order to manufacture the centrifugal fan, it is needed that the side plate is formed as a separate member separate from the fan body composed of the blade plates and the main plate, and then the side plate is joined to the fan body.

The centrifugal fan is composed with plural members joined to each other. In this case, the balance may get worse during rotation of the centrifugal fan. Further, the strength decreases at the joint between the plural members, and the cost of the centrifugal fan increases.

The inventors considered integrally molding the centrifugal fan as a single member using a die. Then, it was found that, in order to integrally form the centrifugal fan practically, it is necessary to remove at least the die forming the blade leading edge to one side in the axial direction of the centrifugal fan. The above has been found by the inventors of the present disclosure.

The present disclosure provides a centrifugal fan in which a die forming a blade leading edge can be removed to one side in the axial direction.

According to one aspect of the present disclosure, a centrifugal fan configured to rotate around a fan axis so as to suck air from one side in an axial direction and blow out air outward in a radial direction for a blower, includes:

a plurality of blades arranged around the fan axis and having a blade leading edge;

a side plate connected to each of the plurality of blades on the one side in the axial direction, the side plate having an intake hole to suck air; and a main plate connected to each of the plurality of blades on a side opposite to the side plate.

The side plate has: an upstream tubular portion that surrounds the intake hole and has a tubular shape with the fan axis; and a downstream diameter-expanded portion formed so as to extend outward in the radial direction from an end portion of the upstream tubular portion on the other side opposite to the one side in the axial direction.

The upstream tubular portion has a cylinder inner surface facing the intake hole inward in the radial direction, and the blade leading edge has a convex surface protruding toward an upstream side in an air flow direction between the blades.

The blade leading edge has a tip end extended linearly by an apex of the convex surface along the blade leading edge and connected to the cylinder inner surface, the apex being in a cross section showing a thickness of the blade, and a convex surface end indicating a boundary position between the convex surface and a side surface of the blade, the convex surface end being extended linearly along the blade leading edge.

A relationship of $\Phi a \geq \Phi b \geq \Phi c$ is satisfied, in which the cylinder inner surface has a diameter $\Phi a$ about the fan axis at a first position corresponding to an end position of the upstream tubular portion on the one side in the axial direction, a diameter $\Phi b$ about the fan axis at a second position where the blade leading edge is connected to the cylinder inner surface, and a diameter $\Phi c$ about the fan axis at a third position where the convex surface end is connected to the cylinder inner surface.

As described above, since the blade leading edge is connected to the cylinder inner surface of the side plate, the blades can be formed so that the entire blade leading edge is located inside the cylinder inner surface. Due to the relationship of "$\Phi a \geq \Phi b \geq \Phi c$", at least a die forming the cylinder inner surface located on the one side of the third position in the axial direction can be removed to the one side in the axial direction. Therefore, when manufacturing a centrifugal fan, it is possible to remove the die forming the blade leading edge to the one side in the axial direction.

The reference numerals in parentheses attached to the components and the like indicate an example of correspondence between the components and the like and specific components and the like described in embodiments to be described below.

Hereinafter, embodiments will be described with reference to the drawings. In the following embodiments, the same reference numeral is given to the same or equivalent parts in the drawings.

First Embodiment

A centrifugal blower 10 of the present embodiment is used, for example, in an air-conditioning unit that conditions air for a cabin of a vehicle. As shown in FIG. 1, the centrifugal blower 10 includes a fan case 12, an electric motor 14, and an impeller 16. In the description of this embodiment, the centrifugal blower 10 may be simply referred to as blower 10.

The impeller 16 is a centrifugal fan that rotates around the fan axis CL. The impeller 16 rotates around the fan axis CL to suck air from one side in the axial direction Da of the fan axis CL as shown by arrow A1 and blow out the air outward in the radial direction Dr of the fan axis CL as shown by arrow A2. The axial direction Da of the fan axis CL is, in other words, the axial direction Da of the impeller 16, and the radial direction Dr of the fan axis CL is, in other words, the radial direction Dr of the impeller 16. In the description of the present embodiment, the axial direction Da of the fan axis CL is also referred to as the fan axial direction Da, and the radial direction Dr of the fan axis CL is also referred to as the fan radial direction Dr. In FIG. 1 illustrating the cross section of the blower 10, the illustration on the right side of the paper surface with respect to the fan axis CL as the boundary is omitted, and the illustration of a part of the fan case 12 is also omitted.

The fan case 12 is a non-rotating member that does not rotate, and is made of, for example, resin. The fan case 12 houses the impeller 16 and holds the electric motor 14.

Specifically, the fan case 12 has a one-side case component 121 provided on one side of the impeller 16 in the fan axial direction Da and the other side case component 122 provided on the other side of the impeller 16 in the fan axial direction Da.

A case suction port 121*a*, which is a circular hole centered on the fan axis CL, is formed in the one-side case component 121. Since the case suction port 121*a* is a part of the one-side case component 121, the case suction port 121*a* is positioned on one side of the impeller 16 in the fan axial direction Da. The case suction port 121*a* is an opening provided in the fan case 12 for drawing in air. Air is sucked into the impeller 16 from outside of the fan case 12 through the case suction port 121*a*.

The one-side case component 121 has a bell mouth portion 121*b* around the case suction port 121*a* so as to smoothly guide air from the outside of the fan case 12 into the case suction port 121*a*. That is, the one-side case component 121 has the bell mouth portion 121*b*, and the bell mouth portion 121*b* is configured as a suction portion having the case suction port 121*a* inside.

The bell mouth portion 121*b* has the suction inner surface 121*c* facing the case suction port 121*a* inward in the fan radial direction Dr, as the suction portion having the case suction port 121*a* formed inside the bell mouth portion 121*b*.

The electric motor 14 rotates the impeller 16 by receiving electric power supply. The electric motor 14 has a non-rotating motor body 141 and a motor rotation shaft 142 protruding from the motor body 141 to the one side in the fan axial direction Da.

The motor rotation shaft 142 rotates around the fan axis CL. The motor body 141 is fitted and fixed to a part of the other side case component 122.

The impeller 16 is made of, for example, resin and is manufactured by injection molding using a die. The impeller 16 includes blades 18, a side plate 20, and a main plate 22. The blades 18 are arranged side by side around the fan axis CL. As the impeller 16 rotates, air is circulated between the blades 18 from the inside to the outside in the fan radial direction Dr.

Each of the blades 18 has a blade leading edge 181 which is an upstream end provided on the upstream side in the air flow direction and a blade trailing edge 182 which is a downstream end provided on the downstream side in the air flow direction. Each of the blades 18 has a blade one end 183 provided on the one side in the fan axial direction Da and a blade other end 184 provided on the other side in the fan axial direction Da.

The main plate 22 of the impeller 16 has a disk shape centered on the fan axis CL, and is fixed to the motor rotation shaft 142 at the central portion. As a result, the entire impeller 16 rotates integrally with the motor rotation shaft 142.

The main plate 22 extends in the fan radial direction Dr and is inclined with respect to the fan axis CL so as to extend to the other side in the fan axial direction Da as extending outward in the fan radial direction Dr. The main plate 22 guides the air flowing to the other side in the fan axial direction Da to flow outward in the fan radial direction Dr.

The main plate 22 is connected to each of the blades 18 on the side opposite to the side plate 20. In short, each of the blade other ends 184 of the blades 18 is connected to the main plate 22.

The side plate 20 of the impeller 16 has an annular shape centered on the fan axis CL. The side plate 20 is provided on the one side of the blades 18 in the fan axial direction Da, and is connected to each of the blades 18. In short, each of the blade one ends 183 of the blades 18 is connected to the side plate 20.

The intake hole 20*a* is formed inside the side plate 20 to suck air from the one side in the fan axial direction Da.

Figure 2:
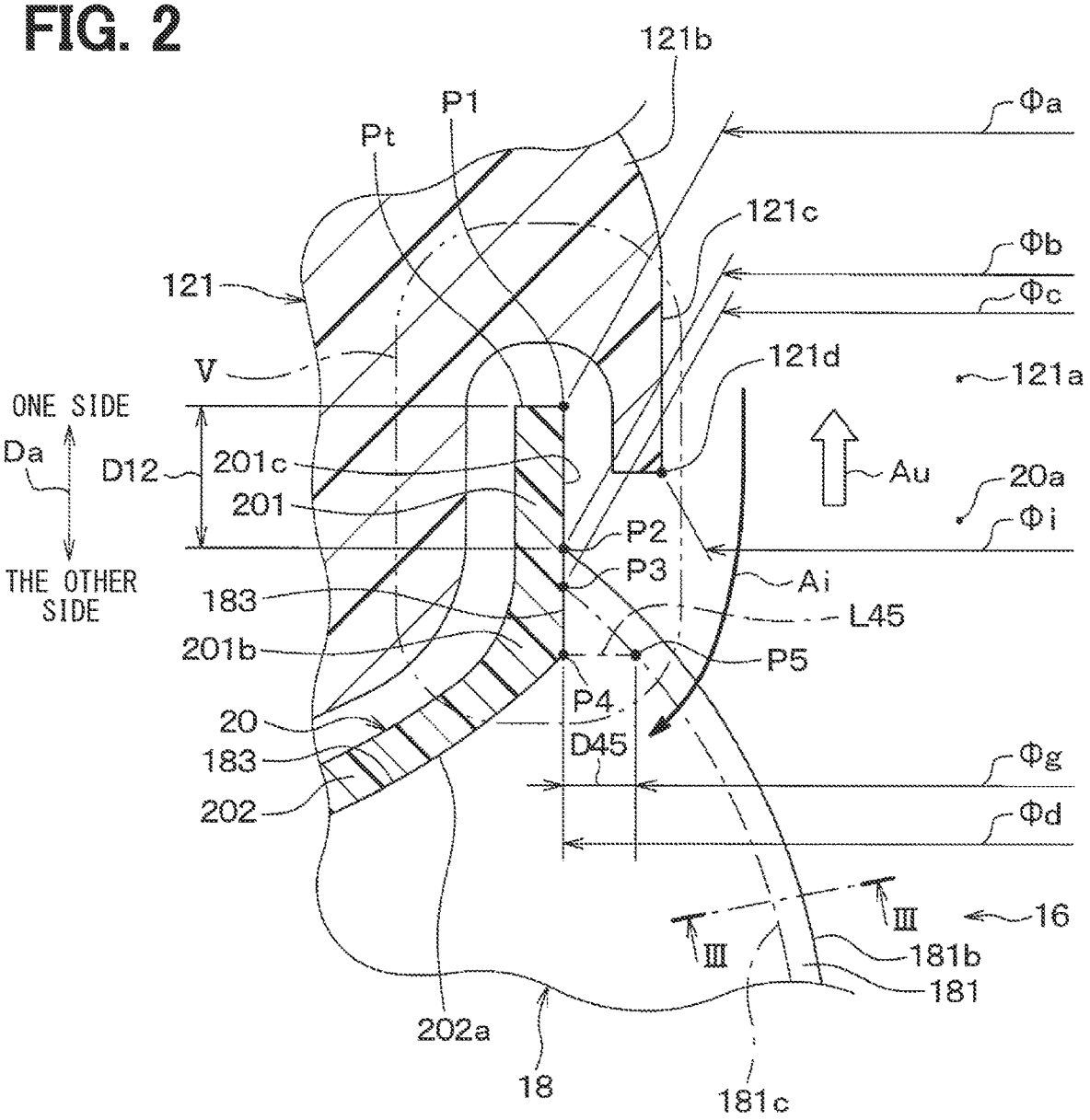
FIG. 2 is an enlarged cross-sectional view showing an area II of FIG. 1.

As shown in FIGS. 1 and 2, the side plate 20 has an upstream tubular portion 201 and a downstream diameter-expanded portion 202. The upstream tubular portion 201 surrounds the intake hole 20*a* and has a tubular shape centered on the fan axis CL. That is, the intake hole 20*a* is formed inside the upstream tubular portion 201 of the side plate 20. Therefore, the upstream tubular portion 201 has a cylinder inner surface 201*c* facing the intake hole 20*a* inward in the fan radial direction Dr. For example, the upstream tubular portion 201 has a substantially cylindrical shape.

The bell mouth portion 121*b* of the fan case 12 is formed so as to enter the inside of the upstream tubular portion 201 of the side plate 20 from the one side in the fan axial direction Da. That is, the bell mouth portion 121*b* is provided so as to partially overlap the upstream tubular portion 201 at the inner side in the fan radial direction Dr.

In the manufacturing process of the impeller 16, the cylinder inner surface 201*c* of the side plate 20 is formed by using a die, and the die is removed to the one side in the fan axial direction Da. The cylinder inner surface 201*c* has a shape that avoids undercuts in the molding of the impeller 16. Specifically, the cylinder inner surface 201*c* is formed such that a normal line of the cylinder inner surface 201*c* is perpendicular to the fan axis CL or inclined so as to extend to the one side in the fan axial direction Da as extending inward in the fan radial direction Dr over the entire length of the cylinder inner surface 201*c*.

The upstream tubular portion 201 has the other end portion 201*b* located on the other side in the fan axial direction Da. The arrow Au in FIG. 2 indicates the removal direction of the die forming the cylinder inner surface 201*c* and the blade leading edge 181.

As shown in FIGS. 1 and 2, the downstream diameter-expanded portion 202 of the side plate 20 is formed so as to extend from the other end portion 201*b* of the upstream tubular portion 201 outward in the fan radial direction Dr. Specifically, the downstream diameter-expanded portion 202 extends in the fan radial direction Dr while being inclined with respect to the fan axis CL so as to extend to the other side in the fan axial direction Da as extending outward in the fan radial direction Dr.

The downstream diameter-expanded portion 202 has a blade-side side surface 202*a* adjacent to the blade 18 in the thickness direction of the downstream diameter-expanded portion 202. The blade-side side surface 202*a* faces the other side in the fan axial direction Da with respect to a direction perpendicular to the fan axis CL. In short, the blade-side side surface 202*a* faces the other side in the fan axial direction Da and faces obliquely inward in the fan radial direction Dr.

The blade-side side surface 202*a* of the downstream diameter-expanded portion 202 is directly connected to the other end portion of the cylinder inner surface 201*c* in the fan axial direction Da. That is, the blade-side side surface 202*a* is formed as a connecting surface located on the other side of the cylinder inner surface 201*c* in the fan axial direction Da and extended from the cylinder inner surface 201*c*.

As shown in FIG. 1, the blade leading edge 181 is connected to the side plate 20 at the one side, and the blade leading edges 181 is connected to the main plate 22 at the other side. As shown in FIG. 2, the blade leading edge 181 is connected to the cylinder inner surface 201*c* of the side plate 20.

Figure 3:
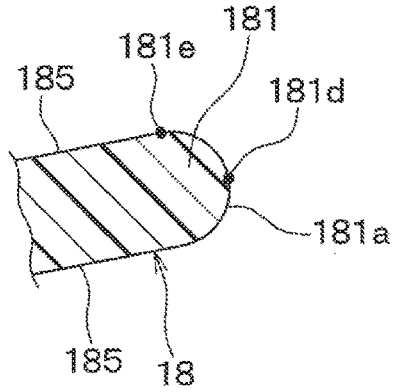
FIG. 3 is a cross-sectional view, taken along a line III-III of FIG. 2, illustrating a blade leading edge of an impeller in the first embodiment.

FIG. 3 shows a cross section showing the thickness of the blade 18. As shown in FIG. 3, the blade leading edge 181 has a convex surface 181*a* protruding toward the upstream side in the air flow direction between the blades 18. For example, the convex surface 181*a* is a curved surface that is convex toward the upstream side in the air flow direction.

As shown in FIGS. 2 and 3, the blade leading edge 181 has a blade leading tip end 181*b* and a convex surface end 181*c*. The blade leading tip end 181*b* is formed by connecting the apex 181*d* of the convex surface 181*a* in the cross section of FIG. 3 along the blade leading edge 181 and extends linearly over the entire length of the blade leading edge 181. Further, the convex surface end 181*c* indicates a boundary position 181*e* between the convex surface 181*a* and the side surface 185 of the blade 18, and extends linearly along the blade leading tip end 181*b*. The convex surface end 181*c* also extends over the entire length of the blade leading edge 181.

As shown in FIG. 2, in order to explain the shape of the upstream tubular portion 201 of the side plate 20 and the shape of the blade leading edge 181, a first position P1 is defined on the cylinder inner surface 201*c* at the end position Pt on the one side of the upstream tubular portion 201 in the fan axial direction Da. Further, a second position P2 is defined on the cylinder inner surface 201*c* where the blade leading tip end 181*b* is connected to the cylinder inner surface 201*c*. Further, a third position P3 is defined on the cylinder inner surface 201*c* where the convex surface end 181*c* is connected to the cylinder inner surface 201*c*.

In this case, the first diameter Φa centered on the fan axis CL at the first position P1, the second diameter Φb centered on the fan axis CL at the second position P2, and the third diameter Φc centered on the fan axis CL at the third position P3 have the magnitude relationship of "Φa≥Φb≥Φc".

Further, a fourth position P4 is defined on the cylinder inner surface 201*c* where the blade-side side surface 202*a* of the downstream diameter-expanded portion 202 is connected to the cylinder inner surface 201*c*. In this case, the third diameter Φc and the fourth diameter Φd centered on the fan axis CL at the fourth position P4 have the relationship of "Φc≥Φd". That is, the first diameter Φa, the second diameter Φb, the third diameter Φc, and the fourth diameter Φd have the relationship of "Φa≥Φb≥Φc≥Φd".

As a confirmation, the first position P1, the second position P2, the third position P3, and the fourth position P4 are all on the cylinder inner surface 201*c* of the side plate 20. Then, the first to fourth positions P1 to P4 are arranged in order of the first position P1, the second position P2, the third position P3, and the fourth position P4 from the one side in the fan axial direction Da.

Further, as can be seen from the arrangement order of the first to fourth positions P1 to P4, in the present embodiment, the convex surface end 181*c* is connected to the cylinder inner surface 201*c* of the side plate 20 at a position on the one side of the fourth position P4 in the fan axial direction Da. When a fifth position P5 is defined on the convex surface end 181*c*, which is the same position as the fourth position P4 in the fan axial direction Da, the fifth position P5 is distant from the fourth position P4 in the fan radial direction Dr. More specifically, the fifth position P5 is separated from the fourth position P4 in the fan radial direction Dr, and is provided on the inner side of the fourth position P4 in the fan radial direction Dr. The radial distance D45 between the fourth position P4 and the fifth position P5 in the fan radial direction Dr is preferably about 1 mm or more in order to secure the practical strength of the die.

In the present embodiment, the tip 121*d* of the suction inner surface 121*c* on the other side in the fan axial direction Da has a tip inner diameter V at the suction portion. The fifth diameter Φg centered on the fan axis CL at the fifth position P5 and the tip inner diameter Φi have the magnitude relationship of "Φg>Φi".

As shown in FIG. 2, the tip 121*d* of the suction inner surface 121*c* is located between the first position P1 and the second position P2 in the fan axial direction Da. For example, the tip 121*d* of the suction inner surface 121*c* is located at the center or substantially the center between the first position P1 and the second position P2 in the fan axial direction Da. Further, the axial distance D12 between the first position P1 and the second position P2 in the fan axial direction Da is preferably about 3 mm or more.

According to the present embodiment, as shown in FIGS. 1 and 2, the blade leading edge 181 is connected to the cylinder inner surface 201*c* of the side plate 20. Therefore, each of the blades 18 can be formed such that the entire blade leading edge 181 is located inside the cylinder inner surface 201*c* in the radial direction.

Further, the first diameter Φa, the second diameter Φb, and the third diameter Φc in FIG. 2 have the relationship of "Φa≥Φb≥Φc". Due to this relationship, at least the die forming a part of the cylinder inner surface 201*c* located on the one side of the third position P3 in the fan axial direction Da can be removed to the one side in the fan axial direction Da as shown by the arrow Au. Therefore, when the impeller 16 is manufactured by molding using the die, the die forming the entire blade leading edge 181 can be moved to the one side in the fan axial direction Da.

The impeller 16 of the present embodiment is an integrally molded product configured as a single member. In other words, the blades 18 of the impeller 16, the side plate 20, and the main plate 22 are integrally formed.

According to the present embodiment, the fourth diameter cd centered on the fan axis CL at the fourth position P4 where the cylinder inner surface 201*c* of the side plate 20 is connected to the blade-side side surface 202*a* of the downstream diameter-expanded portion 202, and the third diameter cc have the relationship of "Φc≥Φd". Therefore, over the entire length of the cylinder inner surface 201*c* of the side plate 20 in the fan axial direction Da, the die can slide away from the cylinder inner surface 201*c* to the one side in the fan axial direction Da as shown by the arrow Au.

According to the present embodiment, the convex surface end 181*c* of the blade leading edge 181 is connected to the cylinder inner surface 201*c* on the one side of the fourth position P4 in the fan axial direction Da. Then, the fifth position P5 on the convex surface end 181*c*, which is at the same position as the fourth position P4 in the fan axial direction Da, is separated from the fourth position P4 in the fan radial direction Dr. Therefore, a line L45 connecting the fourth position P4 and the fifth position P5 in the fan radial direction Dr can be a part of a parting line between the die molding the cylinder inner surface 201*c* of the side plate 20 with the removal direction to the one side in the fan axial direction Da and the other die paired with the die. Therefore, it is not necessary to make the other die to have a sharp shape, so that the durability of the other die can be easily ensured.

According to the present embodiment, the fifth diameter Φg centered on the fan axis CL at the fifth position P5 and the tip inner diameter Φi of the tip 121*d* of the suction inner surface 121*c* have the relationship of "Φg>Φi". Therefore, the flow of air sucked by the impeller 16 can be smoothly guided from the bell mouth portion 121*b* to the blade leading edge 181 of the impeller 16 as shown by the arrow Ai. For example, the air flowing between the blades 18 can be smoothly guided along the side plate 20. As a result, it is possible to appropriately secure the performance of the blower 10.

According to the present embodiment, the bell mouth portion 121*b* of the fan case 12 is formed so as to enter the inside of the upstream tubular portion 201 from the one side in the fan axial direction Da with respect to the upstream tubular portion 201 of the side plate 20. The tip 121*d* of the suction inner surface 121*c* is located between the first position P1 and the second position P2 in the fan axial direction Da. Therefore, it is easy to establish a labyrinth structure between the upstream tubular portion 201 of the side plate 20 and the bell mouth portion 121*b*. Thus, it becomes easy to suppress the return of air inward in the radial direction of the upstream tubular portion 201 when the air flows back through the radially outer side of the upstream tubular portion 201.

Second Embodiment

A second embodiment will be described next. The present embodiment will be explained mainly with respect to portions different from those of the first embodiment. In addition, explanations of the same or equivalent portions as those in the above embodiment will be omitted or simplified. The same applies to a description of embodiments as described later.

Figure 4:
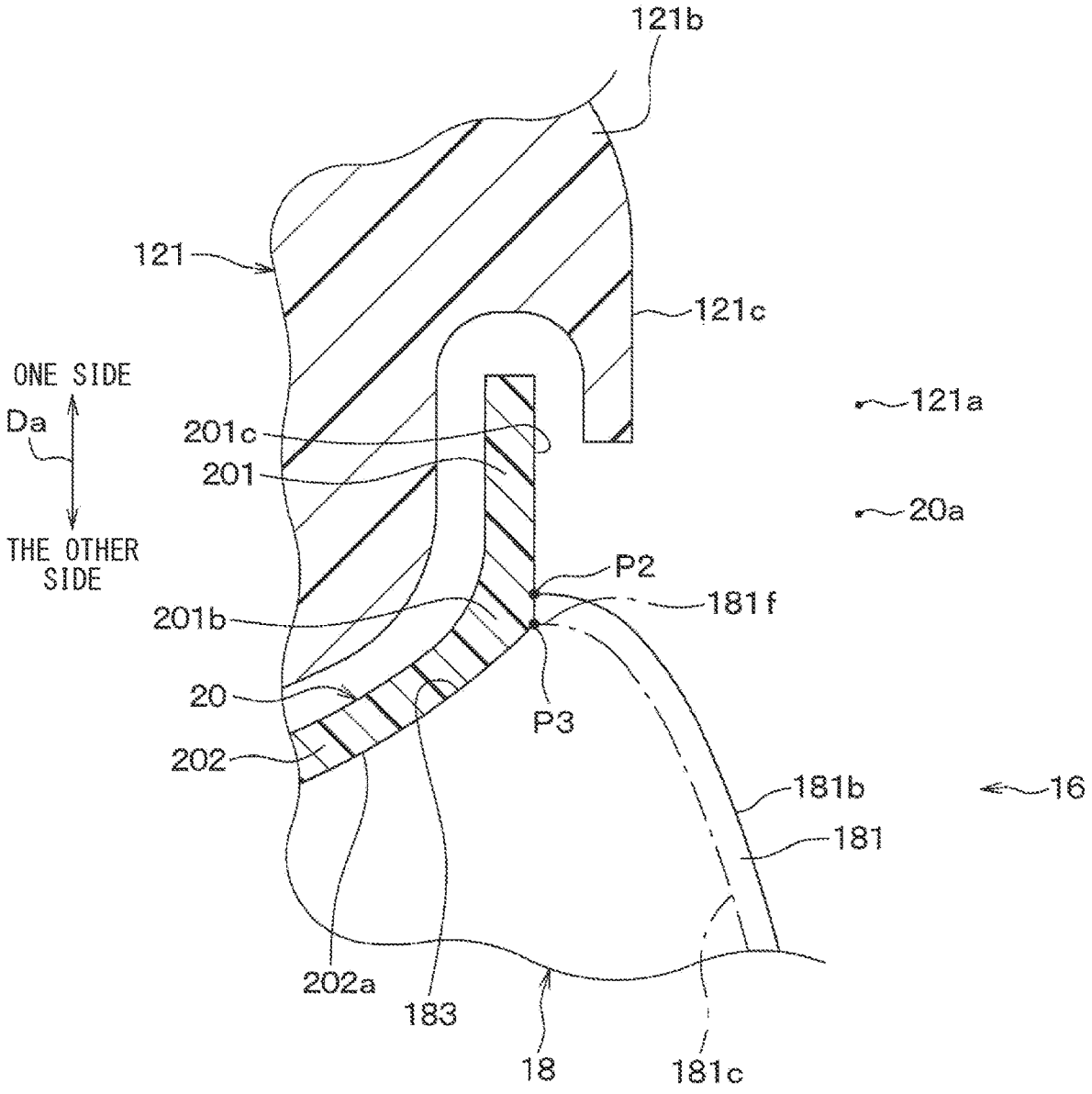
FIG. 4 is an enlarged cross-sectional view illustrating a second embodiment, correspondingly to FIG. 2, while showing an area II of FIG. 1.

As shown in FIG. 4, in the present embodiment, the positional relationship between the downstream diameter-expanded portion 202 of the side plate 20 and the blade leading edge 181 in the impeller 16 and the shape of the blade leading edge 181 are different from those in the first embodiment.

Specifically, in the present embodiment, the blade-side side surface 202*a* of the downstream diameter-expanded portion 202 is connected to the cylinder inner surface 201*c* at the third position P3 where the convex surface end 181*c* of the blade leading edge 181 is connected to the cylinder inner surface 201*c*.

That is, if the blade-side side surface 202*a*, which is a connecting surface on the other side, and the cylinder inner surface 201*c* are defined to connect with each other at the fourth position P4 (see FIG. 2) as in the first embodiment, in this embodiment, it can be said that the fourth position P4 coincides with the third position P3.

The convex surface end 181*c* of the blade leading edge 181 is connected to the cylinder inner surface 201*c* at the third position P3 along the direction perpendicular to the fan axis CL. In other words, the tangential direction of the connection portion 181*f* of the convex surface end 181*c* connected to the cylinder inner surface 201*c* is along the direction perpendicular to the fan axis CL at the third position P3.

Therefore, in the vicinity of the third position P3, the connection portion 181*f* of the convex surface end 181*c* can be a part of a parting line between the die molding the cylinder inner surface 201*c* of the side plate 20 with the removal direction to the one side in the fan axial direction Da and the other die paired with the die. Therefore, it is not necessary to make the other die to have a sharp shape, so that the durability of the other die can be easily ensured.

The "direction perpendicular to the fan axis CL" is not limited to a direction exactly perpendicular to the fan axis CL, but is substantially along the direction perpendicular to the fan axis CL within a predetermined range.

The other parts of the present embodiment are similar to those of the first embodiment. Thus, in the present embodiment, the same effects as the first embodiment described above can be obtained in the same manner as in the first embodiment.

Other Embodiment (1) In each of the embodiments, the centrifugal blower 10 is used in, for example, an air-conditioning unit for a vehicle, but the use of the centrifugal blower 10 is not limited.

Figure 5:
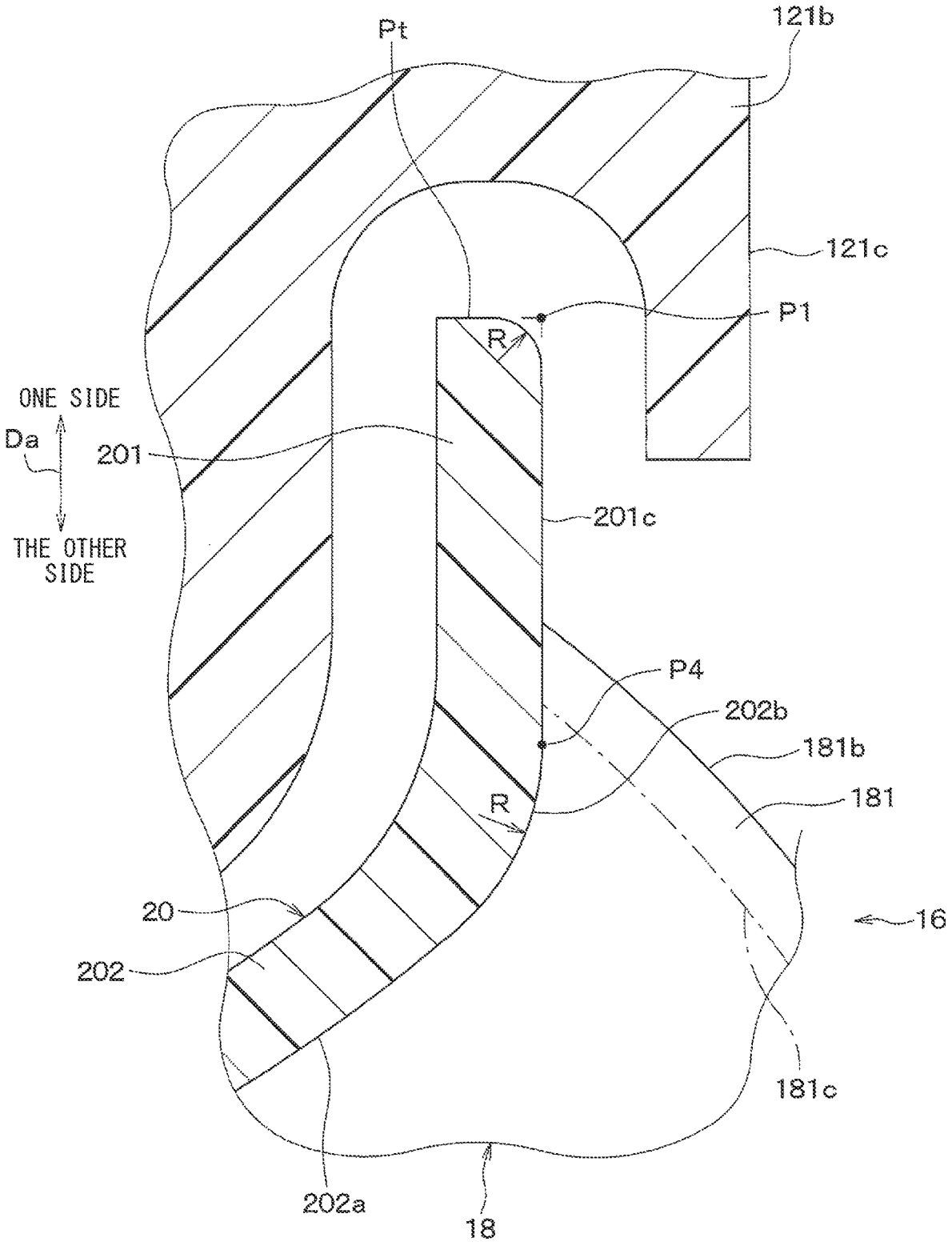
FIG. 5 is an enlarged cross-sectional view illustrating a modification of the first embodiment, corresponding to an area V of FIG. 2.

(2) In each of the embodiments, as shown in FIG. 2, a corner R is not formed at the first position P1 of the upstream tubular portion 201 of the side plate 20, but this is an example. For example, as shown in FIG. 5, a corner R may be formed at the first position P1. In that case, the first position P1 is provided on the cylinder inner surface 201*c* at the end position Pt on the one side of the upstream tubular portion 201 in the fan axial direction Da, assuming that there is no corner R.

(3) In the first embodiment, as shown in FIG. 2, a corner R is not formed between the cylinder inner surface 201*c* and the blade-side side surface 202*a* of the downstream diameter-expanded portion 202, but this is an example. For example, as shown in FIG. 5, a corner R may be formed between the cylinder inner surface 201*c* and the blade-side side surface 202*a*. In that case, the side plate 20 has a corner curved surface 202*b* formed by the corner R, and the corner curved surface 202*b* is provided on the other side of the cylinder inner surface 201*c* in the fan axial direction Da and extended from the cylinder inner surface 201*c*. Therefore, when the corner curved surface 202*b* is provided as shown in FIG. 5, the fourth position P4 is defined where the cylinder inner surface 201*c* is connected to and the corner curved surface 202*b* which is a connecting surface on the other side.

Further, in a modification of the second embodiment in which the corner R is formed between the cylinder inner surface 201*c* and the blade-side side surface 202*a*, the corner curved surface 202*b* serves as a connecting surface on the other side, as in the first embodiment. Therefore, in the modification, at the third position P3, the corner curved surface 202*b* instead of the blade-side side surface 202*a* is connected to the cylinder inner surface 201*c*.

(4) The present disclosure is not limited to the embodiments described above, but can be variously modified. Further, in each of the embodiments, it goes without saying that components of the embodiment are not necessarily essential except for a case in which the components are particularly clearly specified as essential components, a case in which the components are clearly considered in principle as essential components, and the like.

Further, in each of the embodiments described above, when numerical values such as the number, numerical value, quantity, range, and the like of the constituent elements of the embodiment are referred to, except in the case where the numerical values are expressly indispensable in particular, the case where the numerical values are obviously limited to a specific number in principle, and the like, the present disclosure is not limited to the specific number. Further, in each of the embodiments described above, when referring to the material, shape, positional relationship, and the like of the components and the like, except in the case where the components are specifically specified, and in the case where the components are fundamentally limited to a specific material, shape, positional relationship, and the like, the components are not limited to the material, shape, positional relationship, and the like.

(Overview)

According to the first aspect shown in part or all of the embodiments, the upstream tubular portion of the side plate has the cylinder inner surface facing the intake hole inward in the radial direction, and the blade leading edge is connected to the cylinder inner surface. The blade leading edge has: a tip end extended linearly by an apex of the convex surface along the blade leading edge and connected to the cylinder inner surface, the apex being in a cross section showing a thickness of the blade; and a convex surface end indicating a boundary position between the convex surface and a side surface of the blade, the convex surface end being extended linearly along the blade leading edge.

The cylinder inner surface has the diameter Φa centered on the fan axis at the first position corresponding to the end position of the upstream tubular portion on the one side in the axial direction, and the diameter Φb centered on the fan axis at the second position where the tip of the blade leading edge is connected to the cylinder inner surface. In addition, when the cylinder inner surface has the diameter Φc centered on the fan axis at the third position where the convex surface end is connected to the cylinder inner surface, Φa, Φb, and Φc have a relationship of "Φa≥Φb≥Φc".

According to the second aspect, a normal of the cylinder inner surface is perpendicular to the fan axis or inclined such that the cylinder inner surface is extended to the one side in the axial direction as extended inward in the radial direction, along a total length of the cylinder inner surface. The side plate has a connecting surface on the other side of the cylinder inner surface in the axial direction to extend from the cylinder inner surface. The connecting surface faces the other side in the axial direction with respect to a direction perpendicular to the fan axis. When the cylinder inner surface has a diameter Φd about the fan axis at a fourth position where the connecting surface is connected to the cylinder inner surface, a relationship of Φc≥Φd is satisfied. Accordingly, the die forming the cylinder inner surface can slide to the one side in the axial direction over the entire length of the side plate.

According to the third aspect, the convex surface end is connected to the cylinder inner surface at a position on the one side of the fourth position in the axial direction. A fifth position of the convex surface end, which is the same position as the fourth position in the axial direction, is separated from the fourth position in the radial direction. Therefore, a line connecting the fourth position and the fifth position in the radial direction can be a part of a parting line between a die forming the cylinder inner surface of the side plate with the removal direction to the one side in the axial direction, and the other die. Therefore, it is not necessary to make the other die to have a sharp shape, so that the durability of the other die can be easily ensured.

Further, according to the fourth aspect, the side plate has a connecting surface on the other side of the cylinder inner surface in the axial direction to extend from the cylinder inner surface. The connecting surface faces the other side in the axial direction with respect to a direction perpendicular to the fan axis. The connecting surface is connected to the cylinder inner surface at the third position. The convex surface end is connected to the cylinder inner surface at the third position along a direction perpendicular to the fan axis. Therefore, in the vicinity of the third position, a part of the convex surface end along the direction perpendicular to the fan axis can be a part of a parting line between a die forming the cylinder inner surface of the side plate with the removal direction to the one side in the axial direction and the other die. Therefore, as in the third aspect, it is not necessary to make the other die to have a sharp shape, so that the durability of the other die can be easily ensured.

Further, according to the fifth aspect, a blower includes a suction portion included in a non-rotating member, and the suction portion is arranged on the one side of the centrifugal fan in the axial direction. The suction portion has a suction port through which air sucked into the centrifugal fan passes. The suction portion has a suction inner surface that faces the suction port inward in the radial direction. When the diameter about the fan axis at the fifth position is defined as $\Phi g$, and the diameter of a tip end of the suction inner surface on the other side in the axial direction is defined as $\Phi i$, a relationship of $\Phi g > \Phi i$ is satisfied. Therefore, the flow of air sucked by the centrifugal fan can be smoothly guided from the suction portion to the blade leading edge of the centrifugal fan, and the performance of the blower can be appropriately ensured.

Further, according to the sixth aspect, in a blower, the suction portion is formed to enter an inner side of the upstream tubular portion from the one side in the axial direction, and a tip end of the suction inner surface on the other side in the axial direction is located between the first position and the second position in the axial direction. Therefore, it is easy to establish a labyrinth structure between the upstream tubular portion of the side plate and the suction portion. Thus, the air flowing back through the radially outer side of the upstream tubular portion is easily restricted from returning to the radially inner side of the upstream tubular portion.

What is claimed is:

1. A centrifugal fan configured to rotate around a fan axis so as to suck air from one side in an axial direction and blow out air outward in a radial direction for a blower, comprising:

a plurality of blades arranged around the fan axis and having a blade leading edge;

a side plate connected to each of the plurality of blades on the one side in the axial direction, the side plate having an intake hole to suck air; and a main plate connected to each of the plurality of blades on a side opposite to the side plate, wherein the side plate has an upstream tubular portion that surrounds the intake hole and has a tubular shape with the fan axis, and a downstream diameter-expanded portion extended outward in the radial direction from an end portion of the upstream tubular portion on the other side opposite to the one side in the axial direction, the upstream tubular portion has a cylinder inner surface facing the intake hole inward in the radial direction, the blade leading edge has a convex surface protruding toward an upstream side in an air flow direction between the blades, the convex surface has an apex and a convex surface end indicating a boundary position between the convex surface and a side surface of the blade in a cross section representing a thickness of the blade, the apex continuing along the blade leading edge and connected to the cylinder inner surface such that the blade leading edge has a tip end extended linearly, the convex surface end being extended linearly along the blade leading edge, the cylinder inner surface has a diameter $\Phi a$ about the fan axis at a first position corresponding to an end position of the upstream tubular portion on the one side in the axial direction, a diameter $\Phi b$ about the fan axis at a second position where the blade leading edge is connected to the cylinder inner surface, and a diameter $\Phi c$ about the fan axis at a third position where the convex surface end is connected to the cylinder inner surface, and a relationship of $\Phi a \geq \Phi b \geq \Phi c$ is satisfied.

2. The centrifugal fan according to claim 1, wherein a normal of the cylinder inner surface is perpendicular to the fan axis or inclined such that the cylinder inner surface extends to the one side in the axial direction as extended inward in the radial direction, along a total length of the cylinder inner surface, the side plate has a connecting surface on the other side of the cylinder inner surface in the axial direction to extend from the cylinder inner surface, the connecting surface faces the other side in the axial direction with respect to a direction perpendicular to the fan axis, the cylinder inner surface has a diameter cd about the fan axis at a fourth position where the connecting surface is connected to the cylinder inner surface, and a relationship of $\Phi c \geq \Phi d$ is satisfied.

3. The centrifugal fan according to claim 2, wherein the convex surface end is connected to the cylinder inner surface at a position on the one side of the fourth position in the axial direction, and a fifth position of the convex surface end, which is the same position as the fourth position in the axial direction, is separated from the fourth position in the radial direction.

4. The centrifugal fan according to claim 1, wherein the side plate has a connecting surface on the other side of the cylinder inner surface in the axial direction to extend from the cylinder inner surface, the connecting surface faces the other side in the axial direction with respect to a direction perpendicular to the fan axis, the connecting surface is connected to the cylinder inner surface at the third position, and the convex surface end is connected to the cylinder inner surface at the third position along a direction perpendicular to the fan axis.

5. A blower comprising: the centrifugal fan according to claim 3; and a suction portion of a non-rotating member that does not rotate, wherein the suction portion is arranged on the one side of the centrifugal fan in the axial direction, and has a suction port through which air sucked into the centrifugal fan passes, the suction portion has a suction inner surface that faces the suction port inward in the radial direction, the convex surface end has a diameter cg about the fan axis at the fifth position, a tip end of the suction inner surface on the other side in the axial direction has a diameter Φi, and a relationship of Φg>Φi is satisfied.

6. A blower comprising: the centrifugal fan according to claim 1; and a suction portion of a non-rotating member that does not rotate, wherein the suction portion is arranged on the one side of the centrifugal fan in the axial direction, and has a suction port through which air sucked into the centrifugal fan passes, the suction portion has a suction inner surface that faces the suction port inward in the radial direction, the suction portion is formed to enter an inner side of the upstream tubular portion from the one side in the axial direction, and a tip end of the suction inner surface on the other side in the axial direction is located between the first position and the second position in the axial direction.

* * * * *